US011733725B2

(12) United States Patent
Raducan et al.

(10) Patent No.: US 11,733,725 B2
(45) Date of Patent: Aug. 22, 2023

(54) VOLTAGE REGULATOR

(71) Applicant: Infineon Technologies AG, Neubiberg (DE)

(72) Inventors: Cristian-Valentin Raducan, Sebes (RO); Alina-Teodora Cirlescu, Cluj-Napoca (RO); Marius-Georghe Neag, Cluj-Napoca (RO)

(73) Assignee: Infineon Technologies AG, Neubiberg (DE)

( * ) Notice: Subject to any disclaimer, the term of this patent is extended or adjusted under 35 U.S.C. 154(b) by 0 days.

(21) Appl. No.: 17/348,207

(22) Filed: Jun. 15, 2021

(65) Prior Publication Data

US 2021/0389790 A1 Dec. 16, 2021

(30) Foreign Application Priority Data

Jun. 16, 2020 (DE) ..... 102020115851.3

(51) Int. Cl.
*G05F 1/575* (2006.01)
*G05F 1/56* (2006.01)

(52) U.S. Cl.
CPC ..... *G05F 1/575* (2013.01); *G05F 1/56* (2013.01)

(58) Field of Classification Search
CPC ..... G05F 1/575; G05F 1/569; G05F 1/585; G05F 1/59; G05F 1/573; G05F 1/565
See application file for complete search history.

(56) References Cited

U.S. PATENT DOCUMENTS

| | | | |
|---|---|---|---|
| 6,064,188 | A | 5/2000 | Takashima et al. |
| 9,588,541 | B1 | 3/2017 | Ho et al. |
| 10,175,706 | B2 | 1/2019 | Golara et al. |
| 2002/0046354 | A1 | 4/2002 | Ostrom et al. |

(Continued)

FOREIGN PATENT DOCUMENTS

| | | | |
|---|---|---|---|
| CN | 104765397 | A | 7/2015 |
| CN | 110162130 | A | 8/2019 |

(Continued)

OTHER PUBLICATIONS

Suresh, A., et al., "Fully on Chip Area Efficient LDO Voltage Regulator", IEEE Tencon 2014—2014 Region 10 Conference, Oct. 22-25, 2014, 5 pages.

(Continued)

*Primary Examiner* — Nguyen Tran
(74) *Attorney, Agent, or Firm* — Slater Matsil, LLP

(57) ABSTRACT

In accordance with one embodiment, a voltage regulator includes a transistor having a load current path connecting an input node with an output node, wherein the input node is configured to receive an input voltage and the output node is configured to provide an output voltage. The voltage regulator further includes a main control loop coupled between the output node and a control electrode of the transistor and configured to control a voltage applied to the control electrode so that the output voltage matches a set-point. Furthermore, the voltage regulator includes a supplemental control loop that is coupled between the output node and the control electrode of the transistor and configured to detect a transient in the output voltage and to adjust the voltage applied to the control electrode in response to the detection of a transient. A corresponding method is described.

21 Claims, 7 Drawing Sheets

(56) References Cited

U.S. PATENT DOCUMENTS

| | | | | |
|---|---|---|---|---|
| 2003/0218450 | A1 | 11/2003 | Bonte | |
| 2006/0022652 | A1 | 2/2006 | Nishimura et al. | |
| 2006/0227478 | A1 | 10/2006 | Herr et al. | |
| 2007/0030054 | A1 | 2/2007 | Lee et al. | |
| 2007/0053115 | A1 | 3/2007 | Tain et al. | |
| 2007/0268008 | A1 | 11/2007 | Gicquel et al. | |
| 2009/0001953 | A1 | 1/2009 | Huang | |
| 2009/0212753 | A1 | 8/2009 | Lou | |
| 2011/0001458 | A1 | 1/2011 | Bansal et al. | |
| 2012/0176107 | A1 | 7/2012 | Shrivas et al. | |
| 2013/0257402 | A1 | 10/2013 | Wang et al. | |
| 2014/0117956 | A1* | 5/2014 | Price | G05F 1/613 323/273 |
| 2015/0097534 | A1 | 4/2015 | Bhattad | |
| 2019/0020338 | A1* | 1/2019 | Chellamuthu | H03K 17/145 |
| 2019/0025861 | A1 | 1/2019 | Hung et al. | |
| 2019/0041885 | A1* | 2/2019 | Hu | G05F 1/575 |
| 2019/0107856 | A1 | 4/2019 | Lim | |
| 2019/0113942 | A1 | 4/2019 | Murukumpet et al. | |

FOREIGN PATENT DOCUMENTS

| | | | |
|---|---|---|---|
| DE | 102017109615 | A1 | 11/2017 |
| JP | 2000099172 | A | 4/2000 |
| WO | 2019118094 | A1 | 6/2019 |

OTHER PUBLICATIONS

Coulot, Thomas et al., "Fully Integrated Power Management Unit (PMU) Using NMOS Low Dropout Regulators", EuroCon 2013, Croatia, Jul. 1-4, 2013, 8 pages.

Eung, Ka Nang, "A CMOS Low-Dropout Regulator With a Momentarily Current-Boosting Voltage Buffer", IEEE Transactions on Circuits and Systems—I: Regular Papers, vol. 57, No. 9, Sep. 2010, 8 pages.

Mandal, Debashis et al., "Adaptively Biasd Output Cap-Less NMOS LDO With 19 ns Settling Time", IEEE Transactions on Circuits and Systems—II: Express Briefs, vol. 66, No. 2, Feb. 2019, 167 pages.

* cited by examiner

VOLTAGE REGULATOR

This application claims the benefit of German Application No. 102020115851.3, filed on Jun. 16, 2020, which application is hereby incorporated herein by reference in its entirety.

TECHNICAL FIELD

The present disclosure relates to the field of voltage regulator circuits, in particular to a low-dropout regulator (LDO regulator) having a fast step response to abrupt load current changes.

BACKGROUND

Voltage regulators (VREGs) with pass transistors coupled in series to the load are widely used in large integrated circuits (ICs) not only to provide stable supply voltages for various supply lines within the chip but also to separate supply lines at the same voltage in order to prevent or reduce coupling-in of noise and leakage. A typical example is separating the supply line of digital circuit portions, which are heavily impacted by switching noise, from the supply line of noise-sensitive analog circuit portions.

In such cases the VREG should minimize the transient overshoots or undershoots occurring in its regulated output voltage when the load current or the supply voltage abruptly varies. Usually, a decoupling capacitor is placed at the VREG output as a charge buffer that filters the transient step response to abrupt load changes. However, integrating sufficiently large capacitors or providing enough pins for external decoupling capacitors are expensive design choices which are not acceptable in many applications.

Apart from relying on large decoupling (filter) capacitors, typical approaches to improving the step response of an LDO regulator to load changes include: increasing the bandwidth of the voltage control loop; employing a high-slew rate error amplifier, and passive local feedback loops. However, the effectiveness of these approaches is limited as they tend to require large current consumption, and they only work with particular types of error amplifiers and pass transistors. In many cases, it is rather difficult to ensure the stability of the resulting LDO regulators because the circuitry that improves the transient response interferes with the operation of the voltage control loop.

In view of the above, there is room for improvement of LDO regulators with regard to their step response without requiring relatively large filter capacitors.

SUMMARY

A voltage regulator is described herein. In accordance with one embodiment, the voltage regulator includes a transistor having a load current path connecting an input node with an output node, wherein the input node is configured to receive an input voltage and the output node is configured to provide an output voltage. The voltage regulator further includes a main control loop coupled between the output node and a control electrode of the transistor and configured to control a voltage applied to the control electrode so that the output voltage matches a set-point. Furthermore, the voltage regulator includes a supplemental control loop that is coupled between the output node and the control electrode of the transistor and configured to detect a transient in the output voltage and to adjust the voltage applied to the control electrode in response to the detection of a transient.

Moreover, a voltage regulation method is described. In accordance with one embodiment, the method includes providing an output voltage to a load using a transistor that has a load current path connecting an input node with an output node. The method further includes controlling—using a main control loop—a voltage applied to a control electrode of the transistor so that the output voltage matches a set-point; detecting a transient in the output voltage; and adjusting the voltage applied to the control electrode in response to the detection of a slope. In one specific embodiment the output of the transient detector may be AC-coupled to the control electrode of the transistor.

BRIEF DESCRIPTION OF THE DRAWINGS

The invention can be better understood with reference to the following drawings and descriptions. The components in the figures are not necessarily to scale; instead emphasis is placed on illustrating the principles of the invention. Moreover, in the figures, like reference numerals designate corresponding parts. In the drawings.

DETAILED DESCRIPTION OF ILLUSTRATIVE EMBODIMENTS

Figure 1:
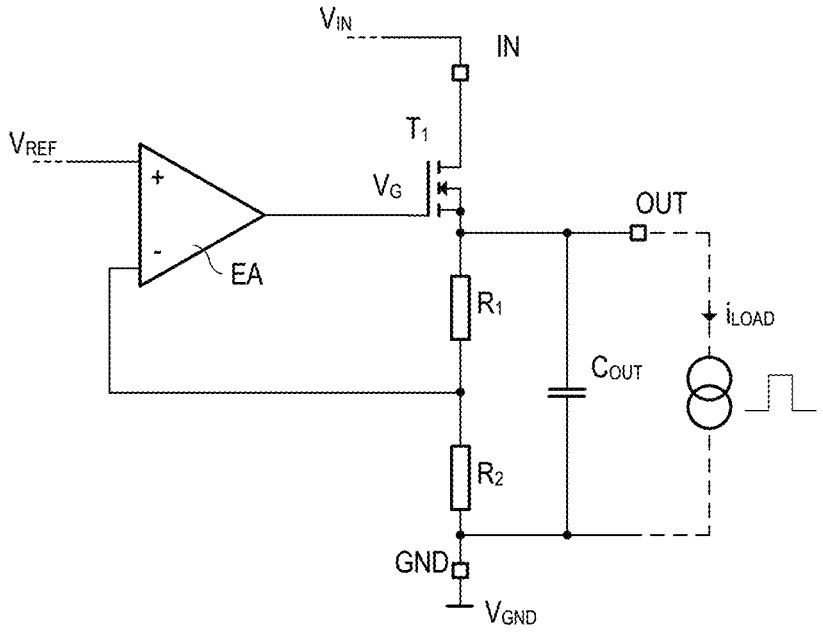
FIG. 1 illustrates one example of a typical VREG structure.
Figure 2:
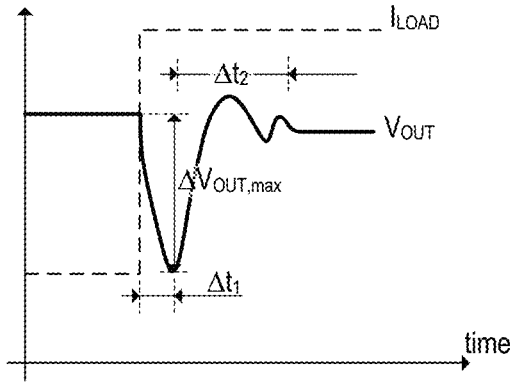
FIG. 2 is an exemplary timing diagram illustrating the step response of the VREG of FIG. 1 to an abrupt increase of the load current.

In the following detailed description, reference is made to the accompanying drawings. The drawings form a part of the description and, for the purpose of illustration, show examples of how the embodiments may be used and implemented. FIGS. 1 and 2 illustrate a simplified circuit diagram of a VREG and, respectively, its step response to abrupt load current changes in a situation, in which the output capacitor has a capacitance small enough to not dominate the step response.

According to the example of FIG. 1 an LDO regulator uses a pass transistor $T_1$ whose load current path is connected between an input node IN and an output node OUT to regulate the output voltage $V_{OUT}$ available at the output node. The pass transistor may be an MOS field effect transistor (MOSFET) for which the load current path is usually referred to as the drain-source current path (equivalent to collector-emitter current path in case of bipolar transistors). N-type or P-type MOS transistors may be used (corresponds to NPN and PNP type in case bipolar transistors are used instead of MOS transistors). The control electrode of the transistor $T_1$, which is the gate in case of a MOS transistors and the base in case to a bipolar transistor, is connected to and driven by the output of an error amplifier EA, which is a difference amplifier such as, for example an operational amplifier. The error amplifier EA receives a reference voltage $V_{REF}$ at its non-inverting input and a feedback voltage $V_{FB}$ at its inverting input, and outputs the control voltage $V_G$ (gate voltage in case of a MOS transistor) which is supplied to the control electrode of transistor $T_1$. The feedback voltage $V_{FB}$ represents the output voltage $V_{OUT}$. In the depicted example, the feedback voltage $V_{FB}$ is proportional to the output voltage $V_{OUT}$, wherein $$V_{FB} = \frac{R_2}{R_1 + R_2} V_{OUT}. \tag{1}$$

That is, the voltage divider composed of the resistors $R_1$ and $R_2$ downscales the output voltage $V_{OUT}$ to obtain the feedback voltage $V_{FB}$. The output capacitor $C_{OUT}$ is connected between the output node OUT and ground node GND.

Given a step in the output current $I_{LOAD}$ from 0 amperes to a maximum value $I_{MAX}$ the maximum output voltage swing $\Delta V_{OUT,max}$ and the response time $\Delta t_1$ of the control loop can be approximated as follows:

$$\Delta V_{OUT,max} \cong \Delta t_1 \frac{I_{MAX}}{C_{OUT}}, \text{ and} \tag{2}$$

$$\Delta t_1 \cong \frac{1}{BW_{cl}} + t_{SR} = \frac{1}{BW_{cl}} + \frac{\Delta V C_{PAR}}{I_{SR}} \tag{3}$$

wherein $BW_{ci}$ is the closed-loop bandwidth of the system, $t_{SR}$ is the time needed to charge the parasitic gate capacitance $C_{PAR}$ of the pass transistor $T_1$, $\Delta V$ is the voltage swing at the gate of the pass transistor, and $I_{SR}$ is the maximum current available to charge/discharge the parasitic gate capacitance $C_{PAR}$.

Apart from relying on large decoupling capacitors, typical approaches to improving the step response of an LDO regulator to load changes include: increasing the bandwidth of the voltage control loop; employing a high-slew rate error amplifier, and passive local feedback loops. However, the effectiveness of these approaches is limited as they tend to require large current consumption, and they only work with particular types of error amplifiers and pass transistors. In many cases, it is rather difficult to ensure the stability of the resulting LDO regulators because the circuitry that improves the transient response interferes with the operation of the voltage control loop.

The embodiments described herein aim at overcoming at least some of these issues. According to some embodiments, a circuit for detecting fast transients (transient detector), which does not interfere with the operation of the main voltage-control loop, is added to the typical VREG structure shown in FIG. 1. The transient detector may be used together with several types of error amplifiers such as, for example, Miller operational transconductance amplifiers (OTAs) or folded cascode OTAs. These can be used together with both, N-type and P-type, pass transistors and are effective in reducing the transient output voltage overshoot/undershoot caused by sharp variations of the load current $I_{LOAD}$.

Figure 3:
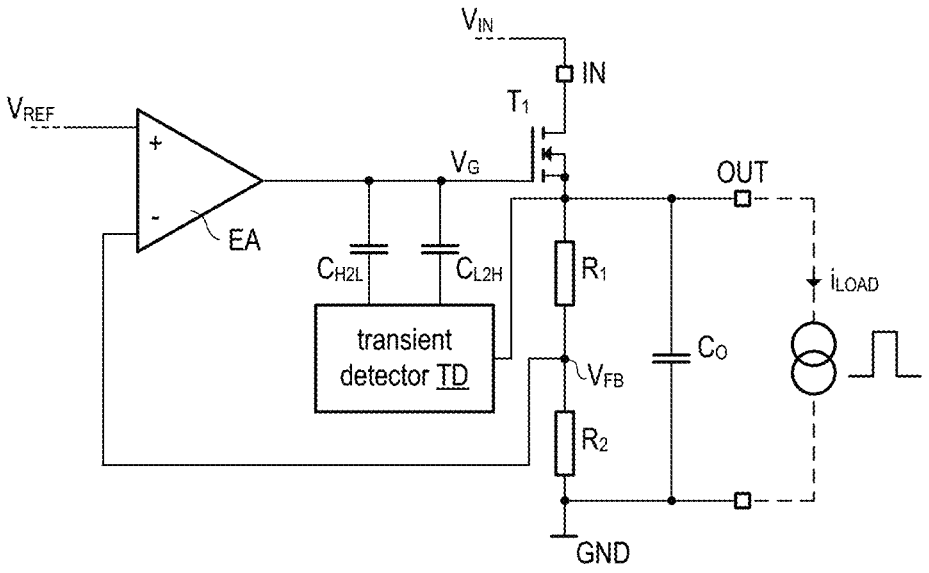
FIG. 3 illustrates one embodiment of an improved VREG structure.
Figure 4A:
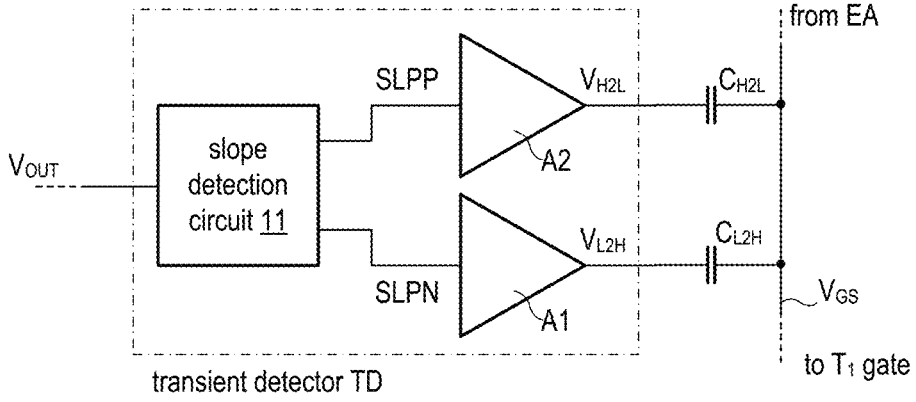
FIGS. 4*a* and 4*b* illustrate two exemplary implementations of a transient detector used in the embodiment of FIG. 3.
Figure 4B:
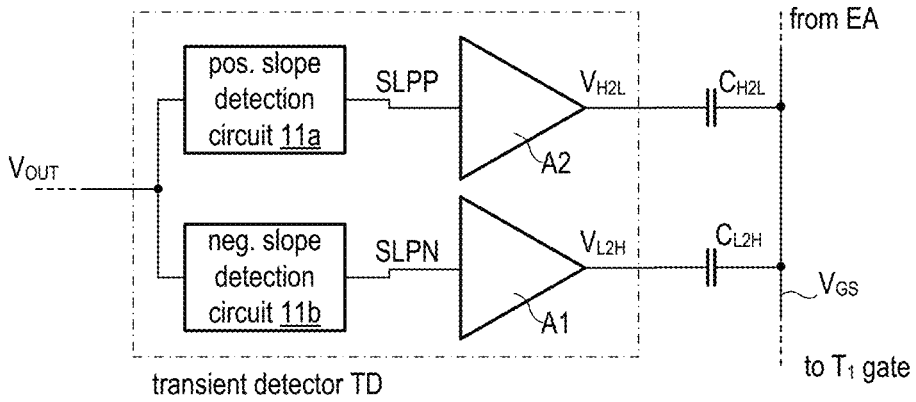

FIG. 3 illustrates one embodiment which includes the mentioned transient detector. The circuit of FIG. 3 is the same as in FIG. 1 except for the additional transient detector TD that is coupled to the output node to receive the output voltage $V_{OUT}$. Further, the transient detector has a first and a second output coupled to the gate electrode of the transistor $T_1$ via a first capacitor $C_{L2H}$ and a second capacitor $C_{H2L}$, respectively. As can be seen in FIG. 3, the transient detector forms part of a second, fast control loop that can operate independent from the main control loop formed by the error amplifier EA. The transient detector TD is configured to detect the slope (amplitude and sign) of output voltage transients, and the information is conveyed to two (one for each sign, i.e. positive and negative slopes) amplifiers that directly drive the gate electrode of transistor $T_1$. The amplifiers are shown in FIG. 4*a* and FIG. 4*b* (denoted as amplifiers $A_1$ and $A_2$), illustrate two exemplary implementations of the transient detector TD of FIG. 3. Accordingly, the amplifiers $A_1$ and $A_2$ drive the gate of transistor $T_1$ only during output voltage transients and their outputs are AC-coupled (i.e. DC-decoupled) to the gate of transistor $T_1$ by using capacitors $C_{H2L}$ and $C_{L2H}$ (dependent on whether a positive or a negative slope is detected), so that in steady-state operation the transient detector TD does not interfere with the main voltage control loop. The example of FIG. 4*a*, includes one slope detection circuit 11 that is configured to detect positive slopes and negative slopes in the regulated output voltage Vo-r. Positive slopes are characterized by a positive time derivative ($dV_{OUT}/dt>0$) while negative slopes are characterized by a negative time derivative ($dV_{OUT}/dt<0$). The example of FIG. 4*b*, may be regarded as special case of the example of FIG. 4*a*. Accordingly, a first slope detection circuit 11*a* and a second detection circuit 11*b* are used to detect positive and, respectively, negative slopes.

When the value of the output voltage $V_{OUT}$ decreases—for example, due to a suddenly increasing load current—the slope detection circuit 11 generates a signal SLPN at its first output, which indicates the detection of the (negative) slope. The amplifier $A_1$ receives the signal SLPN which triggers the injection of charge into (i.e. a charging of) the capacitor $C_{L2H}$. As capacitor $C_{L2H}$ is connected between the output of amplifier $A_1$ and the gate of the transistor $T_1$, it follows that the gate voltage $V_G$ (and thus also the gate-source voltage $V_GS$) of the transistor $T_1$ increases, which results in a lower on-resistance $R_{ON}$ of the transistor load current path. Therefore, the voltage drop across the transistor load current path is reduced which counteracts the output voltage decrease; the value of the output voltage $V_{OUT}$ again increases, even before the main voltage control loop (including the error amplifier EA) is able to react to the initial output voltage transient. Finally, the output voltage $V_{OUT}$ is driven back to its steady-state value with the help of the main feedback loop.

Similarly, when the value of the output voltage $V_{OUT}$ increases—for example, due to a suddenly decreasing load current—the slope detection circuit 11 generates a signal SLPP at its second output, which indicates the detection of the slope. The amplifier $A_2$ receives the signal SLPP which triggers a discharge of the capacitance $C_{H2L}$ which is connected to the output of amplifier $A_2$. As capacitor $C_{H2L}$ is connected between the output of amplifier $A_2$ and the gate of the transistor $T_1$, it follows that the gate voltage $V_G$ of transistor $T_1$ decreases, which results in an increase of the transistors on-resistance $R_{ON}$. Therefore, the voltage drop across the transistor load current path is increased which counteracts the output voltage overshoot; the value of the output voltage $V_{OUT}$ again decreases, even before the main voltage control loop is able to react to the initial output voltage transient. Finally, the output voltage $V_{OUT}$ is driven back to its steady-state value with the help of the main feedback loop. It is understood that the slope detection circuit 11 may include a first slope detection circuit 11*a* for detecting positive slopes and a second slope detection circuit 11*b* for detecting negative slopes. In this case, which is illustrated in FIG. 4*b*, the first slope detection circuit 11*a* provides the signal SLPP and the second slope detection circuit 11*b* provides the signal SLPN.

Figure 5:
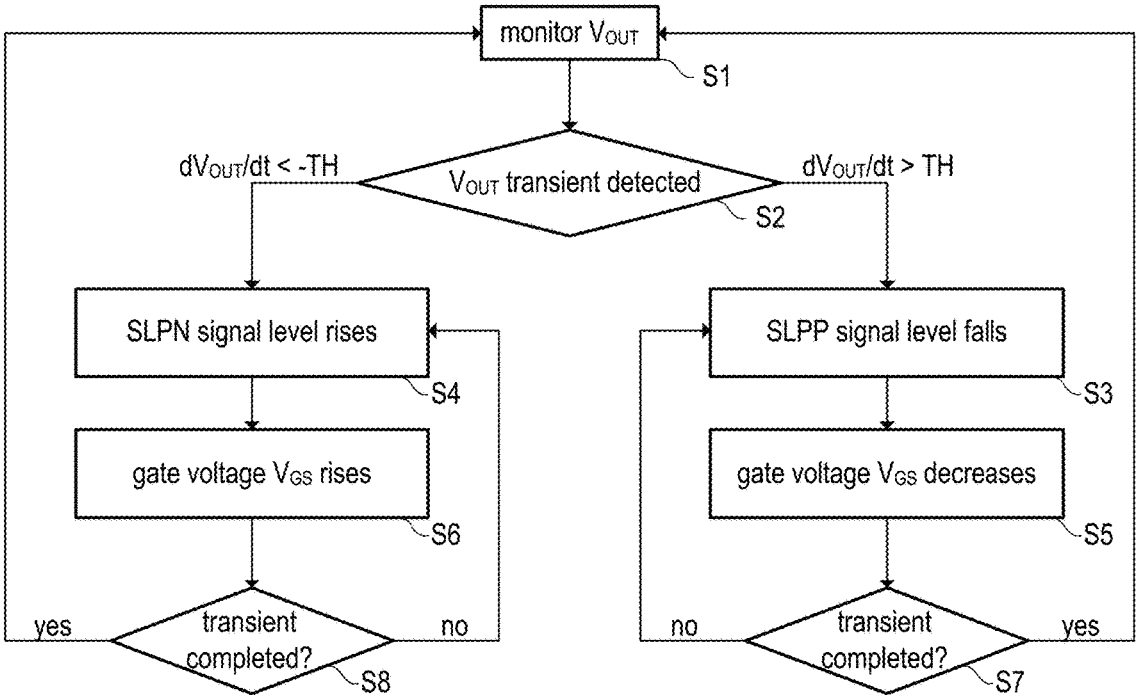
FIG. 5 is a flow chart illustrating the function of the circuit shown in FIG. 3.

Before discussing various implementations of the transient detector TD, the function of the transient detector TD is explained using the flow chart of FIG. 5. During steady state, the transient detector TD has no effect on the regulated output voltage $V_{OUT}$ because the transient detector is AC-coupled to (i.e. DC-decoupled from) the gate electrode of transistor $T_1$. That is, during steady state, the transient detector TD is merely monitoring the output voltage $V_{OUT}$ (see FIG. 5, step $S_1$). As soon as a transient occurs in the output voltage $V_{OUT}$, the transient detector TD detects the transient (see FIG. 5, step $S_2$), wherein two cases are distinguished. At the onset of the transient the slope of the voltage $V_{OUT}$ is either positive ($dV_{OUT}/dt>0$) or negative ($dV_{OUT}/dt<0$). The first case is indicated by the level of signal SLPP falling to a LOW level (see FIG. 5, step $S_3$, SLPP having a HIGH level during steady state and falls to lower values upon occurrence of a positive slope). Similarly, the second case is indicated by the level of signal SLPN rising to a HIGH level (see FIG. 5, step $S_4$, SLPN having a LOW level during steady state and rises to higher values upon occurrence of a negative slope). The signals SLPP and SLPN are amplified (cf. FIG. 3, amplifiers $A_1$ and $A_2$) and—due to the amplifiers $A_1$ and $A_2$ being AC coupled to the gate of transistor $T_1$—the gate voltage $V_G$ decreases (see FIG. 5, step $S_5$) or increases (see FIG. 5, step $S_6$) thereby counteracting the respective transient. This mechanism (steps $S_3$ and $S_5$ or $S_4$ and $S_6$) is maintained as long as the output voltage changes, i.e. as long as the time derivative $dV_{OUT}/dt$ of the output voltage $V_{OUT}$ is positive or negative (see FIG. 5, steps $S_7$ and $S_8$). When the transient has decayed, the transient detector TD again monitors the output voltage $V_{OUT}$ for a further transient (see FIG. 5, step $S_1$). As will be discussed later, the concept illustrated in FIG. 5 can be modified to ensure that the transient detector will only become active when the steepness of the slope is above a specific threshold value TH. In this case, the conditions illustrated in FIG. 5, step S2, are $dV_{OUT}/dt>TH$ for positive slopes and $dV_{OUT}/dt<-TH$ for negative slopes. It is understood that different threshold absolute values may be applied for positive and negative slopes. The threshold may be readily implemented by providing an offset current at the input of the amplifiers $A_1$, $A_2$ (see, e.g. FIG. 9, offset current $i_{CLAMP}$).

Figure 6:
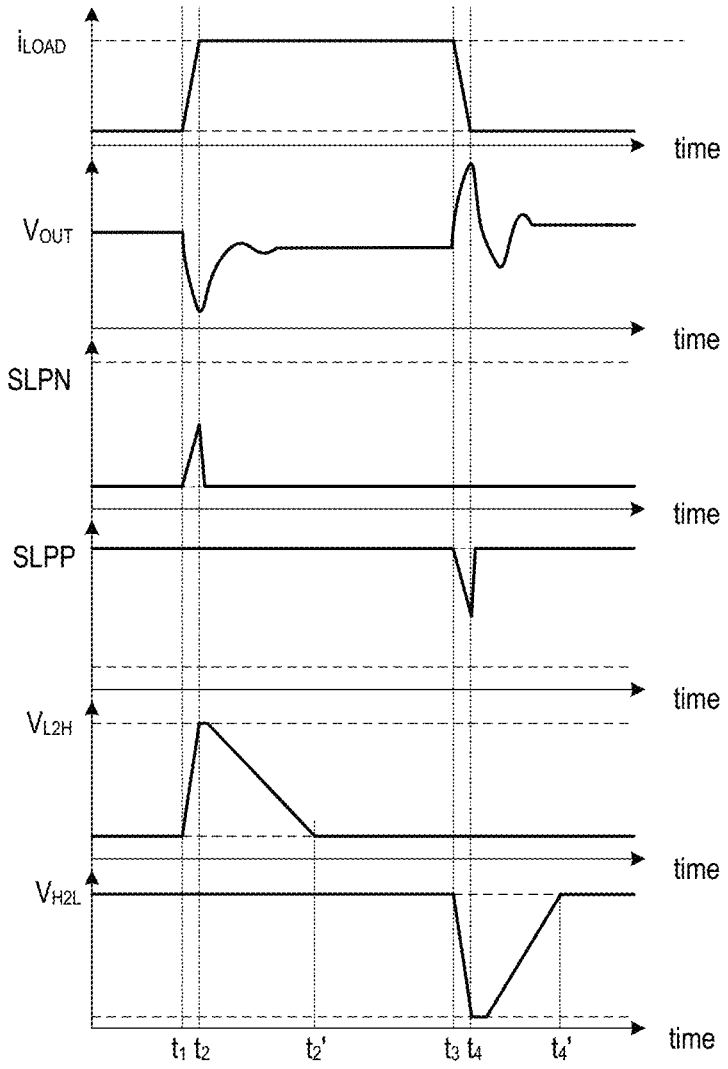
FIG. 6 includes timing diagrams further illustrating the function of the circuit of FIG. 3.

The mechanism explained above with reference to the flow chart of FIG. 5 is further illustrated by the timing diagrams of FIG. 6. In the example of FIG. 6, the load current $i_{LOAD}$ rises from a relatively low level to a higher level at time instant $t_1$ and falls back to the initial low level at time $t_3$ (see top timing diagram of FIG. 6). As a result of the load current change transients occur in the output voltage signal $V_{OUT}$, wherein the first transient (at $t_1$) starts with a negative slope (due to the rising load current) and the second transient (at $t_3$) starts with a positive slope. The transients reach their respective maximum voltage swing at time instants $t_2$ and $t_4$, respectively (see second timing diagram of FIG. 6). The corresponding signals SLPN and SLPP generated by the slope detection circuit 11 (or the slope detection circuits 11*b* and 11*a*, respectively), are illustrated in the third and fourth timing diagram of FIG. 6.

As mentioned above, during steady state (for example before $t_1$) the signal SPLN is at a LOW level and the signal SLPP is at a HIGH level. At time $t_1$—i.e. at the onset of the negative slope—the signal SLPN rises to higher levels. Similarly, at time $t_3$—i.e. at the onset of the positive slope—the signal SLPP drops to lower levels. The signals SLPN and SLPP are amplified by amplifiers $A_1$ and $A_2$ (see FIGS. 3 and 4). These amplifiers may be current output amplifiers, and the output current of the amplifiers charge/discharge the coupling capacitors $C_{L2H}$ and $C_{H2L}$. The corresponding amplifier output voltages $V_{L2H}$ and $V_{H2L}$ are shown in the fifth and the sixth diagram of FIG. 6. It is noted that it may take some time until the capacitor voltages and thus the voltages $V_{L2H}$ and $V_{H2L}$ return to their steady state values (see FIG. 6, times $t_2'$ and $t_4'$).

Figure 7A:
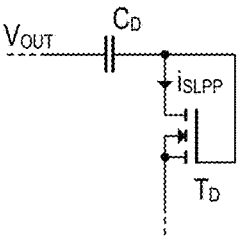
FIGS. 7*a*-7*c* and 8*a*-8*b* include various exemplary implementations of slope detection circuits which may be used in the transient detector of FIG. 4.

FIGS. 7 and 8 illustrate various exemplary implementations of slope detection circuits which may be used in the transient detector of FIGS. 3 and 4. In these implementations the slope detectors have a current output, i.e. the signals SPLN and SPLP are represented by currents $i_{SLPN}$ and $i_{SLPP}$. For example, FIG. 7*a* illustrates a simple differentiator circuit composed of a capacitor $C_D$ that is used as differentiator and connected to a transistor $T_D$ operating as a MOS diode (i.e. a transistor $T_D$ whose gate is biased with the drain voltage). The current $i_{SLPP}$ passing through the capacitor $C_D$ is substantially proportional to the (positive) time derivative $dV_{OUT}/dt$ of the monitored output voltage. Various implementations of differentiator circuits exist. In an alternative example, the transistor is replaced by a simple resistor to obtain an RC differentiator circuit. In the examples described herein, a passive circuit element like a capacitor $C_D$ is used as differentiator. It is understood that active differentiators may also be used instead, which e.g. include one or more operational amplifiers.

Figure 7B:
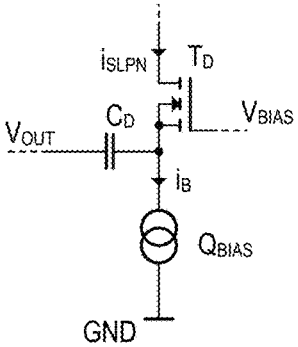

FIG. 7*b* illustrates a further exemplary implementation of a (negative) slope detection circuit. In this example, a bias current source $Q_{BIAS}$ (providing current $i_B$) is connected between ground and the source electrode of a transistor $T_D$ whose gate is biased with a constant volt $V_{BIAS}$. Further, the source electrode of transistor $T_D$ is coupled to the output voltage $V_{OUT}$ to be monitored. The bias voltage $V_{BIAS}$ is set to a value such that the current source $Q_{BIAS}$ remains active during negative slopes of the output voltage signal $V_{OUT}$. As a result, the drain current $i_{SLPN}$ of transistor $T_D$ increases above the value of bias current $i_B$ in response to the negative slope of output voltage $V_{OUT}$.

Figure 7C:
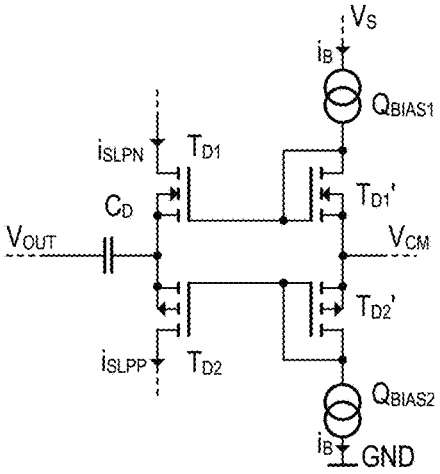

FIG. 7*c* illustrates another exemplary implementation of a slope detection circuit, which is able to detect both, positive and negative slopes in the output voltage to be monitored. In this example, a first current mirror composed of n-channel MOS transistors $T_{D1}$ and $T_{D1}'$ and a second current mirror composed of p-channel MOS transistors $T_{D2}$ and $T_{D2}'$ are coupled in series as shown in FIG. 7*c*. Accordingly, the source electrodes of the transistors $T_{D1}'$ and $T_{D2}'$ are connected at a circuit node which is biased with a voltage $V_{CM}$ (common mode voltage). The drain electrodes of the transistors $T_{D1}'$ and $T_{D2}'$ are connected with the respective gate electrodes. Thus, the transistors $T_{D1}'$ and $T_{D2}'$ form the input branches of the two current mirrors. Further, the drain electrode of transistor $T_{D2}'$ is coupled with a low supply potential (e.g. ground potential) via a current source $Q_{BIAS2}$. Similarly, the drain electrode of transistor $T_{D1}'$ is coupled with a high supply potential $V_S$ via another current source $Q_{BIAS1}$. The load current paths of transistors $T_{D1}'$ and $T_{D2}'$ may be regarded as input branches of the current mirrors.

The source electrodes of transistors $T_{D1}$ and $T_{D2}$, whose load current paths may be regarded as output branches of the current mirrors, are connected to each other at a circuit node that is coupled to the output voltage to be monitored via a capacitor $C_D$. The drain currents of transistors $T_{D1}$ and $T_{D2}$ are denoted as $i_{SLPN}$ and, respectively, $i_{SLPP}$ and represent the signals SLPN and SLPP discussed above and shown in FIG. 4. During steady state, the drain currents of $T_{D1}$ and $T_{D2}$ are equal to bias currents $i_B$ set by current sources $Q_{BIAS1}$ and, respectively, $Q_{BIAS2}$. During a negative slope of the output voltage $V_{OUT}$, the current passing through capacitor $C_D$ will be subtracted from the common circuit node of the source electrodes of transistors $T_{D1}$ and $T_{D2}$. As a result, the drain currents $i_{SLPN}$ will increase and $i_{SLPP}$ will decrease by the same difference amount. Similarly, a positive slope in the output signal $V_{OUT}$ will cause a current through capacitor $C_D$ that will be injected into the common circuit node of the source electrodes of transistors $T_{D1}$ and $T_{D2}$. Consequently, the drain currents $i_{SLPP}$ will increase and $i_{SLPN}$ will decrease by the same amount. In essence, the examples of FIGS. 7*b* and 7*c* may be regarded as current buffers having a differentiator (differentiating element, capacitor $C_D$) coupled to their inputs.

Figure 8A:
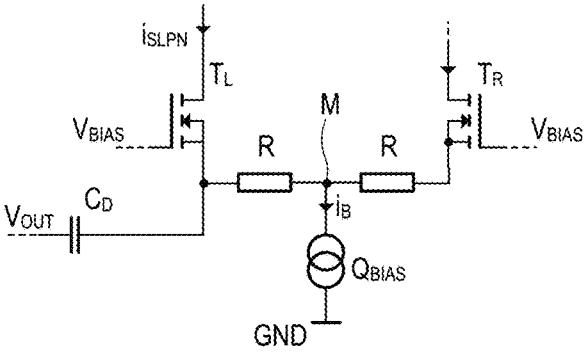
Figure 8B:
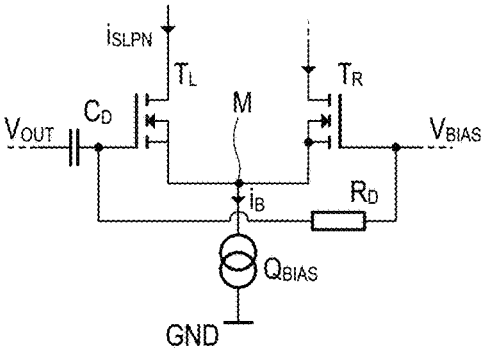

FIG. 8 illustrates two further exemplary implementations of slope detection circuit, which make use of differential pairs (also known as long-tailed pairs). In the example of FIG. 8*a*, the source electrodes of transistors $T_L$ and $T_R$ are connected via two resistors R, wherein the common circuit node M between the two resistors R is coupled to the lower supply potential (ground potential) via a bias current source $Q_{BIAS}$ providing a bias current $i_B$. The gate electrodes of both transistors $T_L$ and $T_R$ are biased with a bias voltage $V_{BIAS}$. The drain current of transistor $T_L$ is the output current $i_{SLPN}$. The output voltage $V_{OUT}$ to be monitored is coupled to the source electrode of transistor $T_L$ via capacitor $C_D$. The example of FIG. 8*b*, is constructed very similar to the example of FIG. *a*. However, in FIG. 8*b* the resistors R can be omitted and the source electrodes are directly connected to circuit node N. Instead, a resistor $R_D$ is connected between the gate electrodes of transistors $T_R$ and $T_L$, and the output voltage $V_{OUT}$ to be monitored is coupled to the gate electrode of transistor $T_L$. It is understood that differential pairs are commonly used in difference amplifiers and thus as such known to a skilled person and not discussed in greater detail herein.

Figure 9A:
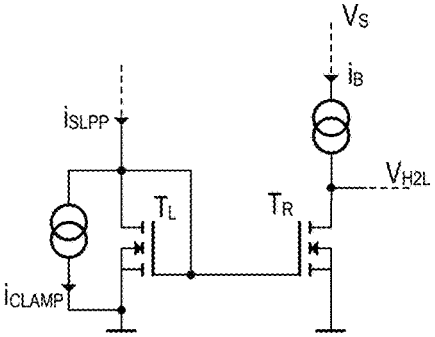
FIGS. 9*a*-9*b* and 10*a*-10*b* include various exemplary implementations of amplifiers which may be used in the transient detector of FIG. 5.

FIG. 9 illustrates two exemplary implementations of current amplifiers that may be used in the transient detector of FIG. 4 (cf. FIG. 4, amplifiers $A_1$ and $A_2$). The two examples illustrated in FIGS. 9*a* and *b*, are based on a 1:K current mirror wherein K denotes the gain. According to the example of FIG. 9*a*, the load current path of transistor $T_L$ forms the input branch and the load current path of transistor $T_R$ forms the output branch of the current mirror. The gate electrodes of both transistors, $T_R$ and $T_L$, are connected to the drain electrode of transistor $T_L$ to form the current mirror. The input current $i_{SLPP}$ is received at the drain electrode of the transistor $T_L$ and the amplifier output voltage $V_{H2L}$ is provided at the drain electrode of transistor $T_R$, which is coupled to the upper supply potential $V_S$ via a current source providing the bias current $i_B$.

Figure 9B:
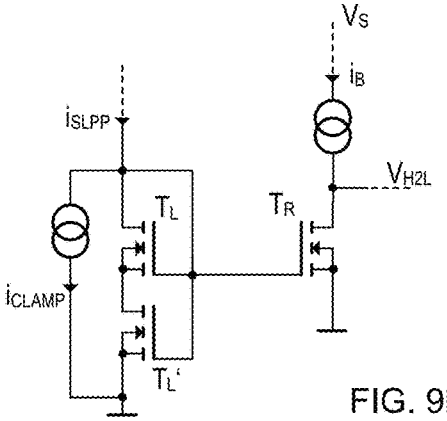

A further current source providing a current $i_{CLAMP}$ is connected in parallel to the load current path of transistor $T_L$. This current $i_{CLAMP}$ can be considered as an offset current subtracted from the current to be amplified. This offset current has the effect that the transient detector does not react to transient with relatively flat slopes. FIG. 9*b* illustrates a minor modification, in which a second transistor $T_L'$ is connected in series to transistors $T_L$ to obtain an amplifier with a non-linear increasing gain.

Figure 10A:
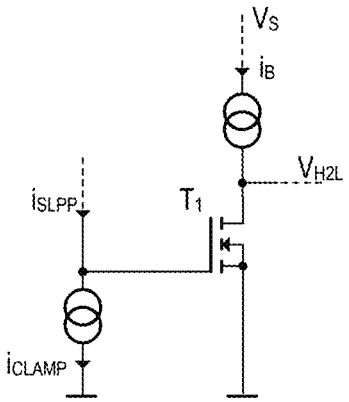

The examples of FIG. 10 illustrate two variants of a common-source amplifier stage which may be used as amplifiers $A_1$ and $A_2$ (see FIG. 4). The amplifier in FIG. 10*a*, uses an n-channel MOS transistor $T_1$ for amplifying the signal SLPP (current $i_{SLPP}$), whereas the amplifier in diagram (b) uses a p-channel MOS transistor $T_2$ for amplifying the signal SLPN (current $i_{SLPN}$). The drain electrodes of transistors $T_1$ and $T_2$ are connected to the (lower and, respectively, upper) supply voltage via current sources providing bias current $i_B$. Similar as in the previous examples of FIG. 9, current sources providing an offset current $i_{CLAMP}$ are connected between the gate electrode of Transistor $T_1$ and $T_2$ and the (lower and, respectively, upper) supply voltage.

Figure 11:
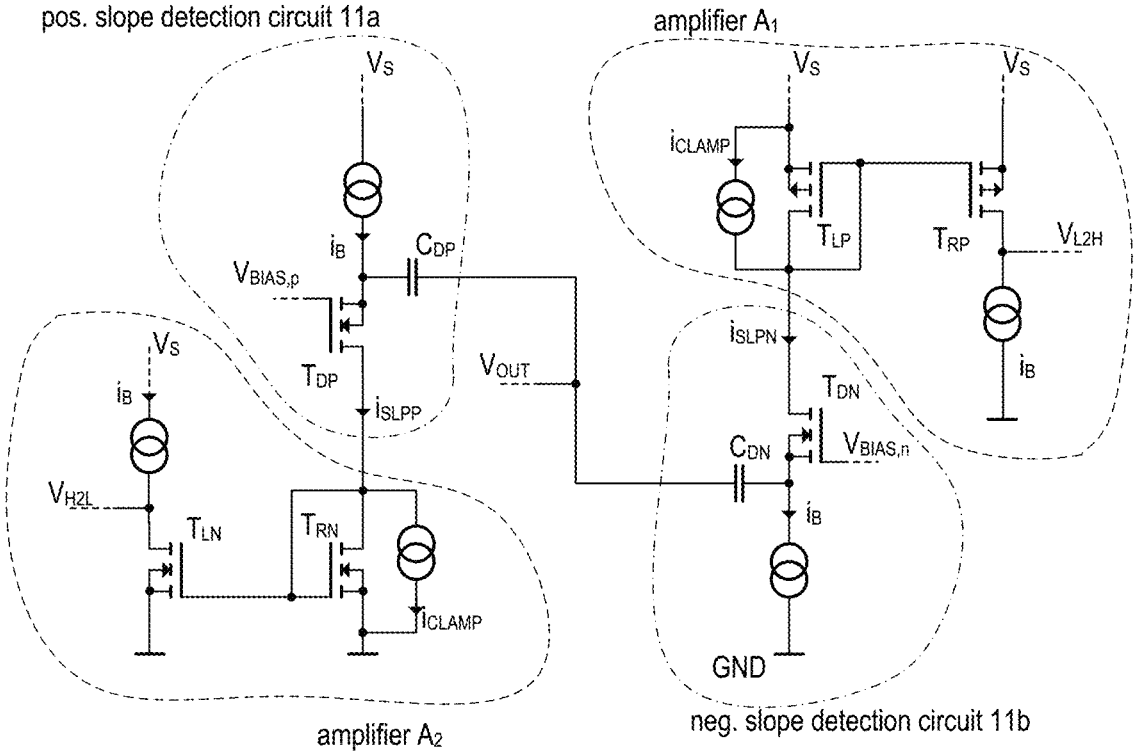
FIG. 11 is a circuit diagram illustrating one example of the transient detector composed of slope detectors constructed in accordance with FIG. 7*b*, and amplifiers constructed in accordance with FIG. 9*a;*

FIG. 11 illustrates one example of the transient detector TD which is composed of slope detection circuits 11*a* and 11*b* for detecting positive and, respectively, negative slopes in the output voltage $V_{OUT}$ to be monitored and amplifiers $A_1$ and $A_2$. In the depicted example, the slope detection circuit 11*b* corresponds to the circuit of FIG. 7*b*. The slope detection circuit 11*a* is the complementary circuit using p-channel MOS transistor $T_{DP}$ (instead of the n-channel MOS transistor $T_{DN}$ used in the slope detection circuit 11*b*). The amplifier $A_2$ in FIG. 11 corresponds to the current mirror circuit of FIG. 9*a*. The amplifier $A_1$ in FIG. 11 is the complementary circuit using p-channel MOS transistors $T_{LP}$ and $T_{RP}$ (instead of the n-channel MOS transistors $T_{LN}$ and $T_{RN}$ used in amplifier $A_2$).

Figure 10B:
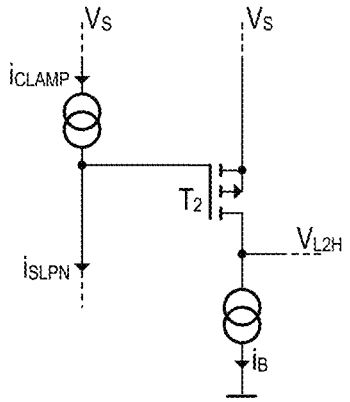
Figure 12:
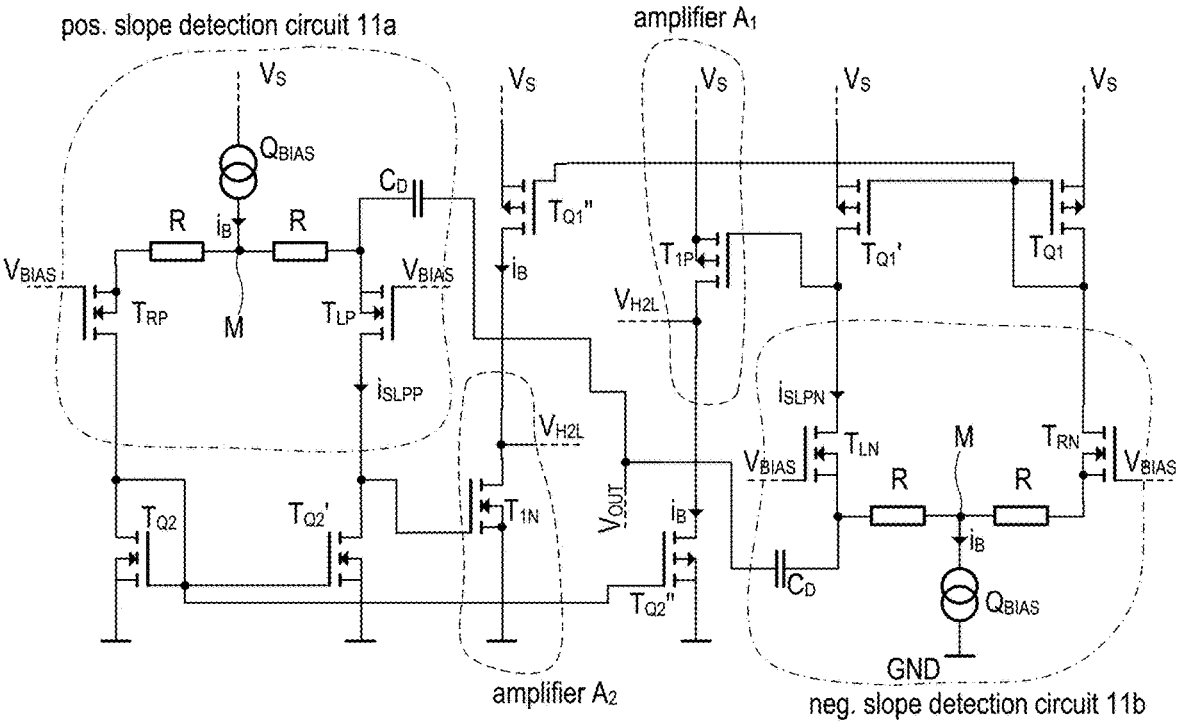
FIG. 12 is a circuit diagram illustrating one example of the transient detector composed of slope detectors constructed in accordance with FIG. 8*a*, and amplifiers constructed in accordance with FIG. 10.

It is understood that the example of FIG. 11 can be modified by using the common-source amplifiers in accordance with FIG. 10*a* and FIG. 10*b*, as amplifiers $A_2$ and $A_1$, respectively (instead of the current mirror circuit of FIG. 9). A further embodiment may be obtained by combining differential pairs in accordance with FIG. 8 (as slope detectors) and current mirror circuits in accordance with FIG. 9 (as amplifiers). The example of FIG. 12 illustrates another example of the transient detector TD which is composed of slope detection circuits 11*a* and 11*b*, which are constructed as differential pairs in accordance with FIG. 8*a*, and amplifiers, which are constructed as common source circuits in accordance with FIG. 10. The differential pair forming the negative slope detection circuit 11*b* corresponds to the circuit of FIG. 8*a*. The positive slope detection circuit 11*a* is the complementary circuit which uses p-channel MOS transistors instead of n-channel MOS transistors. The differential pairs are loaded with current mirrors that are implemented by transistors $T_{Q1}$, $T_{Q1}'$ (for neg. slope detection circuit 11*b*) and $T_{Q2}$, $T_{Q2}'$ (for pos. slope detection circuit 11*a*). Transistors $T_{Q1}'$ and $T_{Q2}'$ are sized N times larger than $T_{Q1}$ and, respectively, $T_{Q2}$ such that they provide a suitable offset current which is subtracted from $i_{SLPN}$ and, respectively, $i_{SLPP}$. Current mirrors as active loads for difference amplifiers are commonly known to a skilled person and thus not further discussed herein. In the current embodiment, the current mirrors have a further output branch formed by transistors $T_{Q1}$" and $T_{Q2}$" which are coupled as active loads to the drains of the transistors $T_{1N}$ and, respectively, $T_{1P}$, which form the common source amplifiers $A_2$ and $A_1$. In the general example of FIG. 10, these active loads are symbolized by the current sources providing bias current $i_B$.

Figure 13:
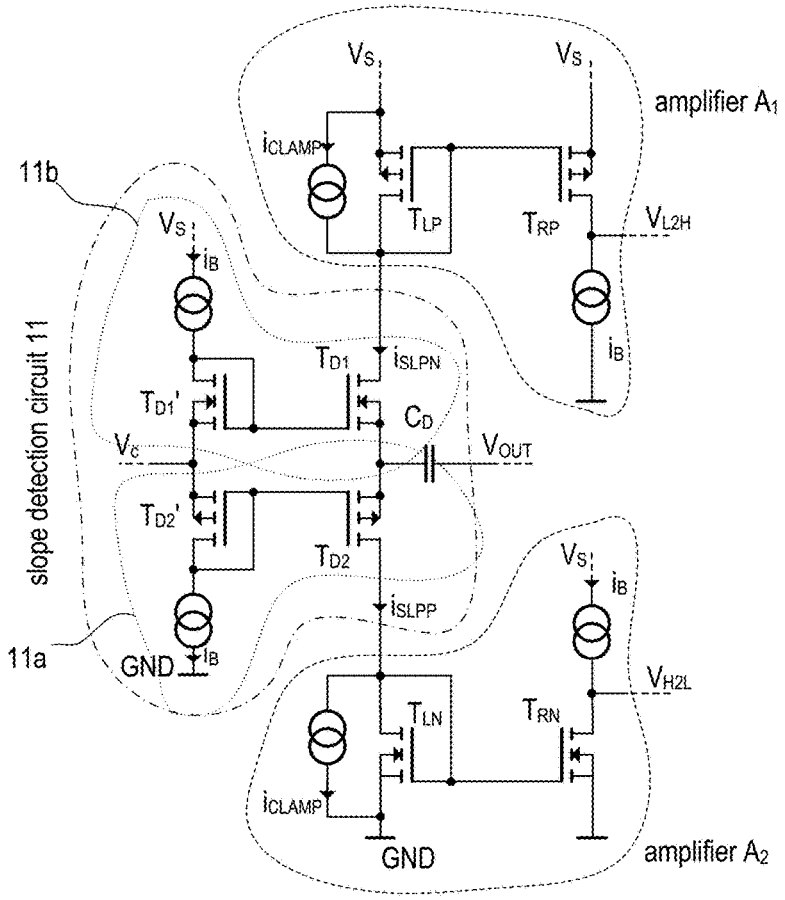
FIG. 13 is a circuit diagram illustrating one example of the transient detector composed of slope detectors constructed in accordance with FIG. 7*c*, and amplifiers constructed in accordance with FIG. 9*a*.

A further exemplary implementation of the transient detector TD is illustrated in FIG. 13. The depicted example is basically a combination of the slope detection circuit 11 of FIG. 7*c*, and the amplifiers $A_1$, $A_2$ constructed in accordance with FIG. 9*a*. Amplifier $A_2$ corresponds to the example of FIG. 9*a*, and amplifier $A_1$ is the complementary circuit using complementary transistor types (p-channel MOS transistors instead of n-channel MOS transistors). It is noted that the slope detection circuit 11 may be regarded as a combination of a positive slope detection circuit 11*a*, which is substantially formed by the current mirror of transistors $T_{D2}$ and $T_{D2}$', and a negative slope detection circuit 11*b*, which is substantially formed by the current mirror of transistors $T_{D1}$ and $T_{D1}$'. Different to the previous examples of FIGS. 11 and 12, only one differentiator—capacitor $C_D$—is needed in the depicted example. The capacitor $C_D$ is used by both parts 11*a* and 11*b* of the slope detection circuit 11.

Although the invention has been illustrated and described with respect to one or more implementations, alterations and/or modifications may be made to the illustrated examples without departing from the spirit and scope of the appended claims. In particular regard to the various functions performed by the above described components or structures (units, assemblies, devices, circuits, systems, etc.), the terms (including a reference to a "means") used to describe such components are intended to correspond—unless otherwise indicated—to any component or structure, which performs the specified function of the described component (e.g., that is functionally equivalent), even though not structurally equivalent to the disclosed structure, which performs the function in the herein illustrated exemplary implementations of the invention.

What is claimed is:

1. A voltage regulator comprising:

a transistor having a load current path connecting an input node with an output node, the input node being configured to receive an input voltage and the output node being configured to provide an output voltage;

a main control loop coupled between the output node and a control electrode of the transistor and configured to control a voltage applied to the control electrode so that the output voltage matches a set-point; and a supplemental control loop coupled between the output node and the control electrode of the transistor and configured to detect a transient in the output voltage and to adjust the voltage applied to the control electrode in response to the detecting the transient in the output voltage, wherein the supplemental control loop includes a slope detection circuit configured to provide a first signal indicating a detection of a negative slope, and a second signal indicating a detection of a positive slope, and an output of the supplemental control loop is AC-coupled to the control electrode of the transistor.

2. The voltage regulator of claim 1, wherein the supplemental control loop further includes:

a first amplifier for amplifying the first signal; and second amplifier for amplifying the second signal, the first amplifier and the second amplifier being AC-coupled to the control electrode of the transistor.

3. The voltage regulator of claim 2, wherein:

the first amplifier is connected to the control electrode of the transistor via a first capacitor; and the second amplifier is connected to the control electrode of the transistor via a second capacitor.

4. The voltage regulator of claim 2, wherein the first amplifier and the second amplifier are current input amplifiers and/or current output amplifiers.

5. The voltage regulator of claim 2, wherein the first amplifier and the second amplifier include at least one of a current source transistor amplifier stage or a current mirror circuit.

6. The voltage regulator of claim 2, wherein the first amplifier and the second amplifier are current input amplifiers each comprising a current source connected to a current input of the respective amplifier, wherein the current source is configured to generate an offset current.

7. The voltage regulator of claim 1, wherein the first signal and the second signal, which are provided by the slope detection circuit, are current signals.

8. The voltage regulator of claim 1, wherein the slope detection circuit includes a differentiator.

9. The voltage regulator of claim 8, wherein:

the differentiator is implemented using a capacitor, or the differentiator is an active differentiator circuit.

10. The voltage regulator of claim 1, wherein:

the slope detection circuit is configured to provide the first signal representing a time derivative of the output voltage, when the output voltage has the negative slope; and the slope detection circuit is configured to provide the second signal representing the time derivative of the output voltage, when the output voltage has the positive slope.

11. The voltage regulator of claim 1, wherein the slope detection circuit includes at least one of: an RC differentiator circuit; a capacitor coupled to an input of a current buffer circuit; or a capacitor coupled to an input of a differential pair circuit.

12. The voltage regulator of claim 1, wherein the main control loop includes an error amplifier configured to receive a feedback voltage representing the output voltage and a reference voltage, the error amplifier having an output coupled to the control electrode of the transistor and providing an output signal that depends on a difference between the reference voltage and the output voltage.

13. The voltage regulator of claim 12, wherein the feedback voltage is provided at a middle tap of a voltage divider connected to the output node.

14. A method comprising:

providing an output voltage to a load using a transistor having a load current path connecting an input node with an output node;

controlling, using a main control loop, a voltage applied to a control electrode of the transistor so that the output voltage matches a set-point;

detecting a transient in the output voltage, wherein detecting the transient comprises generating a signal representing a time derivative of the output voltage; and adjusting the voltage applied to the control electrode in response to the detection of a slope, wherein adjusting the voltage applied to the control electrode comprises AC-coupling a correction signal to the control electrode based on the signal representing the time derivative of the output voltage to counteract the detected transient.

15. The method of claim 14, wherein generating the signal representing the time derivative of the output voltage comprises:

generating a first signal representing the time derivative of the output voltage when the time derivative is negative; and generating a second signal representing the time derivative of the output voltage when the time derivative is positive.

16. The method of claim 15, wherein adjusting the voltage applied to the control electrode comprises: comprises amplifying the first signal or the second signal to form the correction signal.

17. The method of claim 15, wherein:

amplifying the first signal comprises using a first amplifier having an output connected to the control electrode of the transistor via a first capacitor; and amplifying the second signal comprises using a second amplifier having an output connected to the control electrode of the transistor via a second capacitor.

18. The method of claim 17, wherein the first amplifier and the second amplifier are current input amplifiers; and the method further comprises generating an offset current at a current input of the first amplifier and the second amplifier.

19. The method of claim 18, wherein:

the offset current defines a threshold; and slopes having a steepness below an absolute value corresponding to the threshold are not amplified.

20. A circuit comprising:

an amplifier having an output configured to be coupled to a control node of a transistor, a first input configured to be coupled to an output node of the transistor, and a second input configured to be coupled to a reference voltage node; and a transient detection circuit having an input configured to be coupled to the output node of the transistor, the transient detection circuit comprising:

a first slope detection circuit configured to detect a voltage slope in a first direction at the output node of the transistor, the first slope detection circuit configured to be AC coupled to the control node of the transistor, and a second slope detection circuit configured to detect a voltage slope in a second direction opposite the first direction at the output node of the transistor, the second slope detection circuit configured to be AC coupled to the control node of the transistor.

21. The circuit of claim 20, further comprising the transistor.

* * * * *